United States Patent [19]

Polard et al.

[11] Patent Number: 4,670,354

[45] Date of Patent: Jun. 2, 1987

[54] HOT-GALVANIZED STEEL PRODUCT, NOTABLY INTENDED TO BE PHOSPHATED, AND METHOD FOR PREPARING SUCH A PRODUCT

[75] Inventors: Victor Polard, Awans; Jean Palmans, Dalhem; Michel DuBois, Seraing; A. Weymeersch, St. Nicolas, all of Belgium

[73] Assignees: Phenix Works, Flemalle; Cockerill-Sambre, Seraing, both of Belgium

[21] Appl. No.: 753,584

[22] Filed: Jul. 3, 1985

[30] Foreign Application Priority Data

Jul. 6, 1984 [LU] Luxembourg ..... 85453

[51] Int. Cl.[4] ..... B32B 15/04

[52] U.S. Cl. ..... 428/621; 204/38.4; 428/659

[58] Field of Search ..... 428/659, 666, 668, 680, 428/681, 655, 621; 204/15, 28, 32.1, 38.4

[56] References Cited

U.S. PATENT DOCUMENTS

| | | | |
|---|---|---|---|
| 1,984,335 | 12/1934 | Crapo | 204/38.4 |
| 2,038,551 | 4/1936 | Domm | 204/38.4 |
| 2,296,838 | 9/1942 | Domm | 428/659 |
| 3,323,881 | 6/1967 | Nelson et al. | 428/659 |
| 3,816,082 | 6/1974 | Austin et al. | 204/38.4 |
| 4,252,866 | 2/1981 | Matsudo et al. | 428/659 |
| 4,314,893 | 2/1982 | Clauss | 428/659 |
| 4,407,900 | 10/1983 | Kirihara et al. | 428/659 |

FOREIGN PATENT DOCUMENTS

| | | | |
|---|---|---|---|
| 047987 | 3/1982 | European Pat. Off. . | |
| 0125658 | 11/1984 | European Pat. Off. . | |
| 25992 | 2/1984 | Japan | 428/659 |
| 438896 | 11/1935 | United Kingdom . | |
| 1281872 | 7/1972 | United Kingdom . | |
| 1331844 | 9/1973 | United Kingdom . | |
| 1567101 | 5/1980 | United Kingdom . | |

*Primary Examiner*—L. Dewayne Rutledge
*Assistant Examiner*—Robert L. McDowell
*Attorney, Agent, or Firm*—Browdy and Neimark

[57] ABSTRACT

Disclosed is a phosphated steel product and a method for producing the product. The method comprises passing at least one side of a steel strip through a molten bath of a metal selected from the group consisting of Zn-Al and Zn-Fe to form a first coating, electroplating a second coating consisting of essentially a pure metal selected from the group consisting of Mn, Fe and Ni onto the first coating and subjecting the exposed surface of the second coating to a phosphating treatment to form a phosphate coating on the second coating.

6 Claims, 1 Drawing Figure

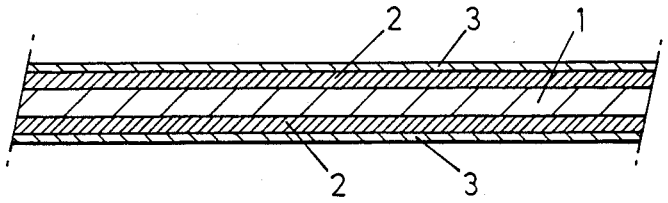
2
3
1
2
3

HOT-GALVANIZED STEEL PRODUCT, NOTABLY INTENDED TO BE PHOSPHATED, AND METHOD FOR PREPARING SUCH A PRODUCT

This invention relates to a steel product, notably a steel product intended to be subjected to a phosphatizing operation, which is protected against corroding by a zinc or zinc-alloy layer, such as a Zn-Al or Zn-Fe alloy coated by dipping in a bath from one or a plurality of molten metals.

It is generally noticed that steel products, notably sheets coated with such a protecting layer, raise problems when such products are intended for the automotive body-building industry where they have to undergo phosphatizing.

Indeed the metal complex layer formed during such phosphatizing operation grips generally with difficulty and/or forms a crystal network which is not optimum on the zinc or zinc-alloy layer said sheet has first been protected with, which leads to a weakness in the paint grip, immediately or after exposure to corrosion.

An essential object of this invention lies in providing a steel product as defined above, which is particularly suitable for such a phosphatizing operation, that is which has a surface with a very good affinity for said metal complexes, in such a way that said latter complexes may on the one hand easily and thoroughly grip said surface during the phosphatizing operation used in the automotive body-building industry, and on the other hand may have an optimum morphology for obtaining a good behaviour of the painted end product relative to adherence tests directly thereafter and/or after exposure to corrosion.

For this purpose according to the invention, said zinc or zinc-alloy layer is coated with a lining formed by an electrolytic depositing of one of the metals or alloys selected from the group formed by Cr, Mn, Co, Ni, Zn, Fe.

Advantageously, said protecting layer is obtained by immersion galvanizing and has preferably a thickness in the range from 6 to 30 microns.

The invention further pertains to a particular method for preparing said above-defined steel product.

This method comprises passing a steel strip one at least from both surfaces of which is protected by a Zn or Zn-alloy layer, such as a Zn-Al or Zn-Fe alloy, laid down from a molten metal bath, at a rate comprised between 20 and 200 m/minute, through an activation section for the surface of said layer, and then through an electrolyte bath containing in solution at least one metal from the group comprised of Cr, Mn, Co, Fe, Zn or Ni, so as to form over said layer, a coating from one metal or alloy selected in the group comprised of Zn, Cr, Mn, Co, Fe, Ni or the alloys thereof.

Other details and features of the invention will stand out from the following description given by way of non limitative example, with reference to the accompanying drawing, the single FIGURE of which is a diagrammatic showing of a cross-section with parts broken-away, of a particular embodiment of part of a metal sheet prepared according to the invention.

Said embodiment pertains more particularly to a steel strip 1 with a thickness from 0.2 to 3 mm and the one surface at least of which is protected by a zinc or zinc-alloy layer 2, such as a Zn-Al or Zn-Fe alloy.

Layer 2 of the strip has is coated in turn by a lining 3 formed by an electrolytic deposit of one of the metals or alloys selected from the group comprised of Zn, Cr, Mn, Co, Fe, Ni or the alloys thereof.

The steel strip coated with the Zn-Al alloy may for example be "galfan", the protecting alloy of which contains 5% aluminum and traces of La and Ce, aluzinc the alloy of which contains about 55% aluminum, 43.5% zinc and about 1.5% silicon, or else galvannealed where the alloy is essentially comprised of Fe and Zn, to the rate of about 10% iron and 0.13% Al.

Said intermediate layer 2 is continuously formed by immersion, for example by galvanizing, and preferably has a thickness in the range from 6 to 30 microns per side.

The obect of seid intermediate layer 2 is to protect the steel strip 1 against corrosion.

The outer coating 3 comprises from 0.05 to 7 g/m$^2$ from one of said metals or alloys. The obect of said outer coating 3 is essentially to make it easier to grip the steel strip coated with zinc or zinc alloys and to optimalize the morphology of the complex metal phosphates applied thereon by a chemical process, the so-called phosphatizing, which is mostly used in the automotive body-building industry.

Indeed when examining and analyzing the outer film of the zinc or zinc-alloy layer 2, it is generally noticed that it contains relatively little and in some cases even no zinc, but depending on the way said layer has been formed, lead, aluminum, carbon, silicon, antimony, tin, magnesium, zirconium, titanium, molybdenum, oxygen, etc, present as the oxide thereof.

It is assumed that the presence of part of or all said elements disturbs the following treatment operations of the steel strip, and notably the phosphatizing operation.

In a rather unexpected way, it has been noticed that when said layer 2 of the steel strip 1 is electrolytically coated with a metal or an alloy of said type by forming the lining 3, there is obtained a better reactivity with the various phosphatation products.

The method for preparing the thus-coated product essentially comprises passing the steel strip 1 at least one of both surfaces of which is protected with a zinc or zinc-alloy layer 2 at a rate between 20 and 200 m/min., through an electrolyte bath containing in solution at least one metal from the group comprised of Cr, Mn, Co, Fe, Zn, or Ni, in such a way as to form over the layer 2, the lining 3 thus comprised of Zn, Cr, Mn, Co, Fe, Ni or the alloys thereof.

In practice, the strip has a width varying between 600 and 1850 mm, while the thickness thereof is from 0.2 to 3 mm, as already stated hereinabove.

The thickness of the intermediate layer 2 generally varies between 6 and 30 microns per side, while the lining 3 generally contains from 0.05 to 7 g/m$^2$ metal per side.

In practice, forming the electrolytic deposit layer may for example be obtained as follows: at the outlet from the molten metal bath (zinc, galfan or aluzinc), after a possible surface-finishing operation (minimizing the patterning), cooling and skin passage, the metal strip dips in a scraping bath (acid or alkaline), electrolytic (cathodic and/or anodic), then in a rinsing bath (hot or cold) before entering the solution proper for electrolytic deposit, then in a rinsing bath (hot or cold) before drying with hot air.

The electrolytic depositing is performed from baths a few composition examples of which are given hereinafter:

1. Cr deposit 80 to 100 gr/l Cr
1 to 2 gr/l $H_2SO_4$
0.5 to 0.8 gr/l F
temperature 40° to 60° C.
current density 7 to 65 A/dm$^2$ 2. Zn deposit
50 to 80 gr/l Zn
60 to 100 gr/l $H_2SO_4$
temperature 40° to 60° C.
current density 40 to 100 A/dm$^2$ 3. Mn deposit
1 to 75 gr/l Mn
50 to 200 gr/l $(NH_4)_2SO_4$
temperature 10° to 60° C.
pH 2 to 8
current density 1 to 30 A/dm$^2$ 4. Ni deposit
320 gr/l Ni sulphamate
15 gr/l $NiCl_2$
38 gr/l $H_3BO_4$
pH 4
temperature 50° to 60° C.
current density 40 to 80 A/dm$^2$ 5. Fe deposit
200 to 250 gr/l $Fe(BF_4)_2$
10 gr/l NaCl
temperature 50° to 70° C.
current density 60 A/dm$^2$ 6. FeZn or ZnFe deposit
2 to 20 gr/l $ZnSO_4$
50 to 70 gr/l $FeSO_4$
5 to 40 gr/l $H_2SO_4$
temperature 40° to 60° C.
current density 80 to 120 A/dm$^2$ 7. ZnNi or NiZn deposit
30 to 60 gr/l Zn
20 to 40 gr/l Ni
40 to 50 gr/l $H_2SO_4$
temperature 40° to 60° C.
current density 70 to 90 A/dm$^2$ In a way known per se, when layer 2 is applied to the steel strip 1 which has been hot-coated with molten metal, such as zinc, galfan or aluzinc, said layer is possibly subjected to a surface-finishing operation to minimize the "patterning", to a cooling operation, to a "skinpass planing", to a pickling, and finally to a rinsing.

It must be understood that the invention is in no way limited to the above embodiments and that many changes may be brought thereto without departing from the scope of the invention as defined by the appended claims.

We claim:

1. A phosphated steel product, comprising:

a first protective coating of a metal selected form the group consisting of Zn-Al and Zn-Fe;

a second protective coating consisting of an essentially pure metal selected from the group consisting of Mn, Fe and Ni electroplated onto said first protective coating, said second protective coating having a phosphated exposed surface.

2. The product of claim 1, wherein said first layer is galvanized and has a thickness of 6 to 30 microns.

3. The product of claim 2, wherein said second protective coating weighs about 0.05 to 7 gr/m$^2$.

4. The product of claim 1, wherein said steel product is a metal sheet.

5. A process for preparing a phosphated steel strip, comprising the steps of:

passing at least one side of a steel strip through a molten bath of a metal selected from a first group consisting of Zn-Al and Zn-Fe, to form a first protective coating upon said at least one side of said steel strip;

electroplating a second protective coating consisting of an essentially pure metal selected from the group consisting of Mn, Fe and Ni onto said first protective coating to form a second protective coating;

subjecting an exposed surface of said second protective coating to a phosphating treatment to form a phosphated layer on said exposed surface of said second protective coating.

6. The product of the process of claim 5.

* * * * *